US011791540B2

(12) United States Patent
Hsu et al.

(10) Patent No.: US 11,791,540 B2
(45) Date of Patent: Oct. 17, 2023

(54) SIGNAL FEEDING ASSEMBLY, ANTENNA MODULE AND ELECTRONIC EQUIPMENT

(71) Applicant: Chiun Mai Communication Systems, Inc., New Taipei (TW)

(72) Inventors: Cho-Kang Hsu, New Taipei (TW); Min-Hui Ho, New Taipei (TW); Yen-Hui Lin, New Taipei (TW); Wei-Cheng Su, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 349 days.

(21) Appl. No.: 17/374,020

(22) Filed: Jul. 13, 2021

(65) Prior Publication Data

US 2022/0021117 A1 Jan. 20, 2022

Related U.S. Application Data

(60) Provisional application No. 63/052,611, filed on Jul. 16, 2020.

(51) Int. Cl.

| | |
|---|---|
| ***H01Q 5/371*** | (2015.01) |
| ***H01Q 3/24*** | (2006.01) |
| ***H01Q 25/04*** | (2006.01) |
| ***H01Q 1/24*** | (2006.01) |
| ***H01Q 23/00*** | (2006.01) |

(Continued)

(52) U.S. Cl.

CPC ..... *H01Q 1/243* (2013.01); *H01Q 3/24* (2013.01); *H01Q 5/371* (2015.01); *H01Q 9/0407* (2013.01); *H01Q 13/085* (2013.01); *H01Q 23/00* (2013.01); *H01Q 25/04* (2013.01)

(58) Field of Classification Search

CPC ..... H01Q 1/243; H01Q 13/085; H01Q 23/00; H01Q 25/04; H01Q 3/24; H01Q 5/371; H01Q 5/40; H01Q 9/0407

USPC ..... 455/82

See application file for complete search history.

(56) References Cited

U.S. PATENT DOCUMENTS

| | | | | |
|---|---|---|---|---|
| 5,898,909 | A * | 4/1999 | Yoshihara | H01L 23/552 257/E23.114 |
| 8,077,116 | B2 | 12/2011 | Shamblin et al. | |
| 9,502,773 | B2 * | 11/2016 | Tsai | H01Q 5/40 |

(Continued)

FOREIGN PATENT DOCUMENTS

| | | | |
|---|---|---|---|
| CN | 102760952 | B | 4/2015 |
| CN | 205039250 | U | 2/2016 |

(Continued)

*Primary Examiner* — Tan H Trinh

(74) *Attorney, Agent, or Firm* — ScienBiziP, P.C.

(57) ABSTRACT

A signal feeding assembly to a radiating element which is not formed from a metal frame or casing includes a substrate, a signal coupling unit, a switching unit, and a transmission unit. The switching unit includes at least two switching output ends. The transmission unit can transmit and receive a baseband signal and an RF signal. The signal coupling unit is spaced from a radiation element and can generate a plurality of radiation modes. The signal coupling unit includes at least two coupling pieces. Each coupling piece is electrically connected to a switching output end. The switching unit controls switching of the coupling pieces through the switching output ends and can switch a plurality of radiation modes. The application also provides an antenna module and an electronic device.

20 Claims, 11 Drawing Sheets

(51) Int. Cl.
*H01Q 9/04* (2006.01)
*H01Q 13/08* (2006.01)

(56) References Cited

U.S. PATENT DOCUMENTS

| | | | | |
|---|---|---|---|---|
| 2012/0182186 | A1* | 7/2012 | Yang | H01Q 9/42 343/700 MS |
| 2017/0141469 | A1* | 5/2017 | Huang | H01Q 1/38 |
| 2020/0052379 | A1* | 2/2020 | Xu | H04B 1/006 |

FOREIGN PATENT DOCUMENTS

| | | | |
|---|---|---|---|
| CN | 104823325 | B | 4/2019 |
| CN | 110854507 | A | 2/2020 |

* cited by examiner

SIGNAL FEEDING ASSEMBLY, ANTENNA MODULE AND ELECTRONIC EQUIPMENT

FIELD

The subject matter herein generally relates to wireless communications, to a signal feeding assembly, an antenna module, and an electronic equipment.

BACKGROUND

Antennas receive and transmit wireless signals at different frequencies. However, current antenna structures may be complicated and occupy a large space in an electronic device, which makes the miniaturization of the electronic device problematic.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
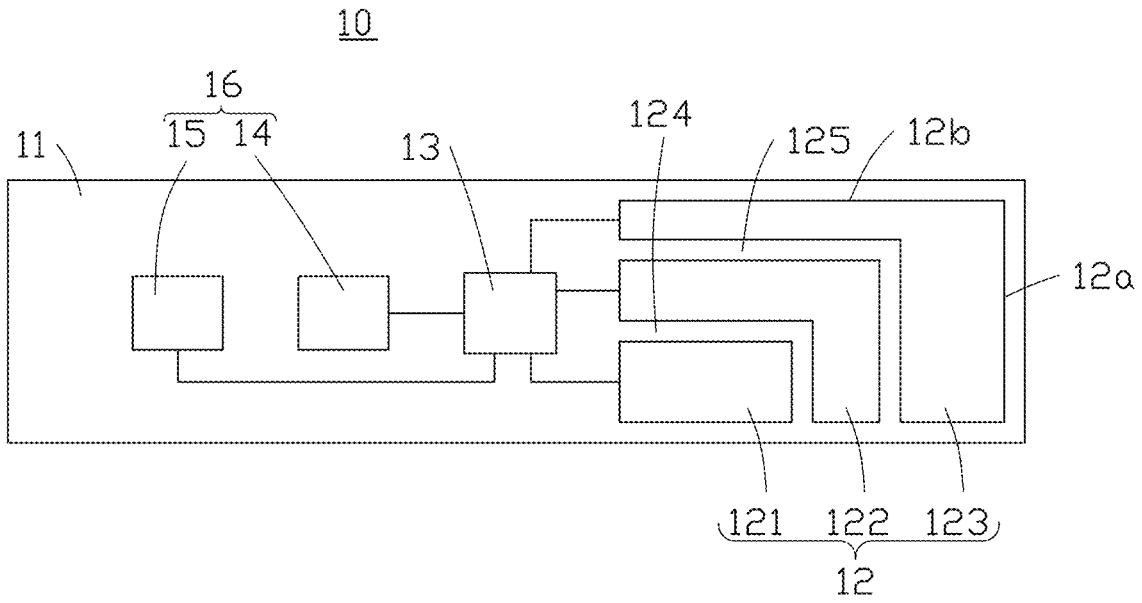
FIG. 1 is a schematic diagram of an embodiment of an antenna module according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better show details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

Intelligent mobile phones have become necessary in modern life. In many products, light weight, screen with a suitable size, and unique appearance design is one of main factors for consumers to choose such products. In addition, product specifications are extended, with more emphasis on highly integrated high-specification hardware communication systems, such as 2G/3G/4G/5G sub-6/BT/Wi-Fi communication network, and sensor devices for medical purposes. Under the trend of light weight, appearance design, and high system integration, improving space utilization is an important issue.

Taking a current design of intelligent mobile phone as an example, a common design is to use metal frame and metal housing. The design can not only enhance a strength of the mechanism, but also has a good appearance. However, for a traditional antenna design, the metal housing has a great impact on a characteristic of the traditional antenna. As far as the current antenna design is concerned, the common way is to make the metal housing with multiple gaps, and make this portion of the metal housing become a part of the antenna. This design can make the antenna and appearance design achieve good integration, and effectively improve a space utilization rate. However, the metal housing still needs compatibility with the initial antenna design, and each product needs to customize a special gap, structure, and circuit design, which cannot be directly used in other products, increasing product development time and cost.

Another common antenna design is slot coupling design, in which energy is coupled to slot antenna through feed coupling. If it is applied to the metal frame or metal housing environment of the mobile phone, the metal housing can be directly designed as a slot antenna, which can more effectively use the space. In order to meet the requirements of system frequency and bandwidth operation, this design still needs to customize the metal housing into slot style and include a traditional ½λ closed slot length or ¼λ slotted hole length, or use adjustable switching elements to switch a resonant frequency. However, the operation bandwidth of this design is not enough for covering multi band operation requirements, such as 2G/3G/4G/5G sub-6/BT/Wi-Fi.

Therefore, the present disclosure provides a signal feeding assembly, an antenna module, and an electronic device. Through a modular design of the signal feeding assembly, combined with a metal radiation element, the antenna module can function for multiple frequency bands, improve the bandwidth, and have a better antenna efficiency.

In detail, as illustrated in FIG. 1, a signal feeding assembly 10 is provided. The signal feeding assembly 10 includes a substrate 11, a signal coupling unit 12, a switching unit 13, a first transmission line 14, and a second transmission line 15.

In this embodiment, the substrate 11 is a microwave substrate. Of course, in other embodiments, the substrate 11 can be a dielectric substrate, for example, a printed circuit board (PCB), a ceramics substrate, or other dielectric substrate.

In this embodiment, the signal coupling unit 12 can be formed on the substrate 11 by printing, etching, or other manner. In this embodiment, the signal coupling unit 12 includes three coupling pieces, namely a first coupling piece 121, a second coupling piece 122, and a third coupling piece 123.

The first to third coupling pieces 121, 122, 123 are sheet metal and arranged to be coplanar. The first to third coupling pieces 121, 122, 123 are spaced from each other. In this embodiment, the signal coupling unit 12 can form the first to third coupling sheets 121, 122, 123 by setting a complete radiation sheet and defining slits on the radiation sheet. For example, the signal coupling unit 12 is a rectangular sheet with a first slit 124 and a second slit 125. The first slit 124 is approximately L-shaped, extending a distance from a short side 12*a* of the signal coupling unit 12 in a direction parallel to the long side 12*b* and towards the other short side 12*a*, then bending at a right angle to extend in a direction parallel to the short side 12*a* and towards the long side 12*b*, until the long side 12*b* is cut off. In this embodiment, the short side 12*a* is vertical to the long side 12*b*.

The second slit 125 is also approximately L-shaped. The second slit 125 has two ends, one on the long side 12*b* and the other on the short side 12*a* of the signal coupling unit 12. In this embodiment, one end of the first slit 124 and one end of the second slit 125 are spaced on the same short side 12*a* of the signal coupling unit 12. The other ends of the first slit 124 and the second slit 125 are spaced on the same long side 12*b* of the signal coupling unit 12. In this way, the first slit 124 and the second slit 125 divide the signal coupling unit 12 into the first to third coupling pieces 121, 122, 123 arranged at intervals. In one embodiment, the first coupling sheet 121 is rectangular. The second coupling sheet 122 and the third coupling sheet 123 are both L-shaped. The surface areas of the first to third coupling pieces 121, 122, 123 gradually increase.

A number, a shape, and a structure of the coupling pieces is not limited. For example, the number of the coupling pieces can also be one, two, or more. The shape of the coupling pieces can also be triangular, square, rectangular, circular, in a polygon, etc.

Figure 2:
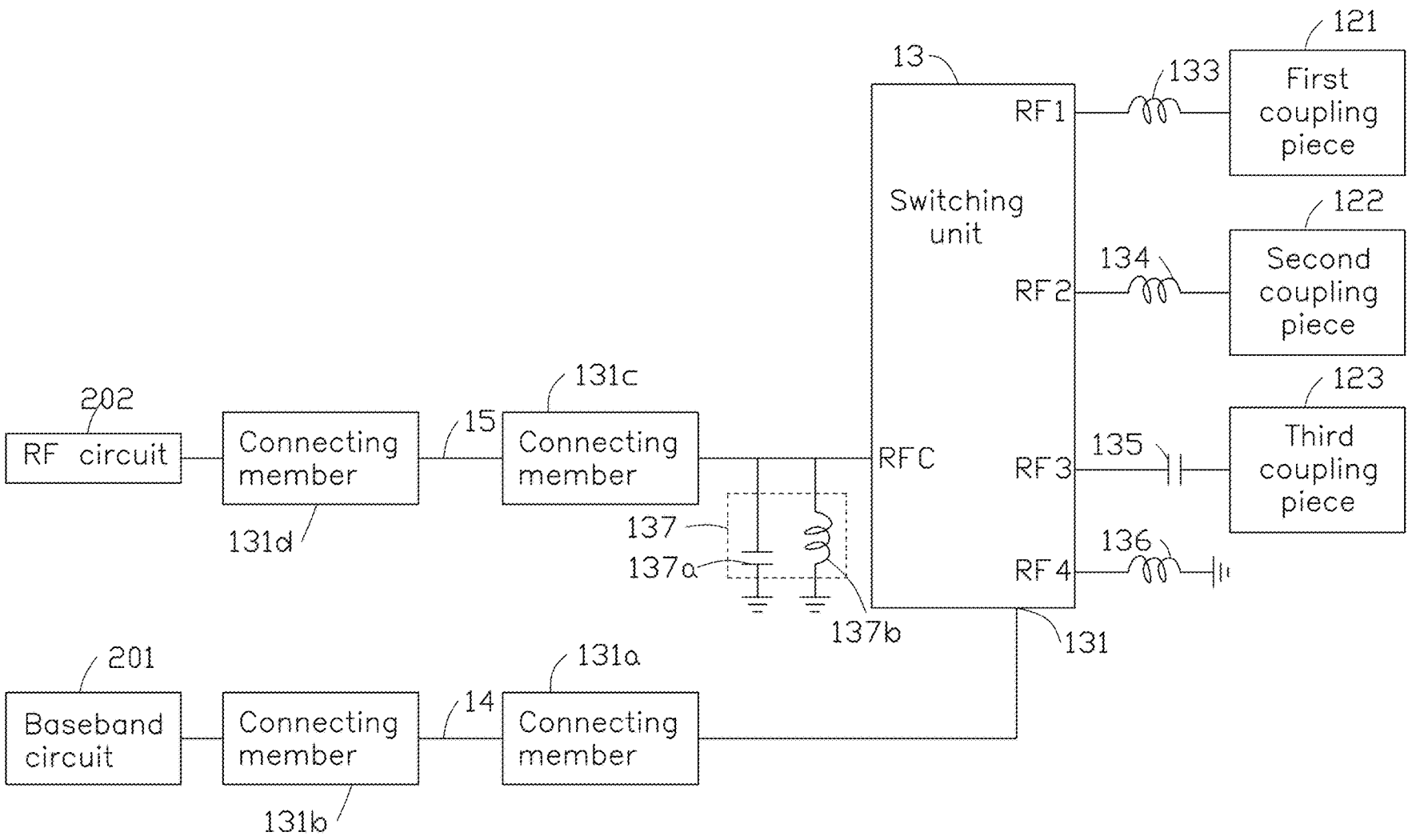
FIG. 2 is a circuit diagram of a signal feeding assembly of the antenna module of FIG. 1.

Referring to FIG. 2, the switching unit 13 is arranged on the substrate 11 and electrically connected with the signal coupling unit 12, the first transmission line 14, and the second transmission line 15. In this embodiment, the signal coupling unit 12 includes three coupling pieces (i.e., the first to third coupling pieces 121, 122, 123), and the switching unit 13 includes four switching output ends, as an example.

Specifically, the switching unit 13 can be a QAT3516 chip, which includes a control end 131, a common end RFC, and four switching output ends. That is, the first to fourth switching output ends are RF1, RF2, RF3, and RF4.

The control end 131 is electrically connected to the first transmission line 14 through a connecting member 131*a*. The first transmission line 14 is electrically connected to a fundamental frequency circuit 201 through a connecting member 131*b*. In this way, the first transmission line 14 can be connected with the basic frequency circuit 201 and the control terminal 131 to transmit control signals from the basic frequency circuit 201.

One end of the common end RFC is electrically connected to the second transmission line 15 through a connecting member 131*c*. The second transmission line 15 is electrically connected to a radio frequency (RF) circuit 202 through a connecting member 131*d*. In this way, the second transmission line 15 can be connected with the RF circuit 202 and the common end RFC to transmit radio frequency signals from the RF circuit 202, such as high frequency signals.

One end of the first switching output end RF1 is electrically connected to the first coupling sheet 121 through a first matching circuit 133. One end of the second switching output end RF2 is electrically connected to the second coupling chip 122 through a second matching circuit 134. One end of the third switching output end RF3 is electrically connected to the third coupling sheet 123 through a third matching circuit 135. One end of the fourth switching output end RF4 is grounded through the fourth matching circuit 136.

In this embodiment, the first matching circuit 133 is an inductor with an inductance value of 2.9 nH. The second matching circuit 134 is an inductor with an inductance value of 0.6 nH. The third matching circuit 135 is a capacitor with a capacitance value of 2.5 pF. The fourth matching circuit 136 is an inductor with an inductance value of 3 nH. In other embodiments, the circuit structures of the first to fourth matching circuits 133, 134, 135, 136 are not limited. For example, the first to fourth matching circuits 133, 134, 135, 136 may also include other capacitors, inductors, and/or combinations of capacitors and inductors.

In this embodiment, the common end RFC can also be grounded through a matching unit 137. In one embodiment, the matching unit 137 includes a first matching element 137*a* and a second matching element 137*b*. One end of the first matching element 137*a* and one end of the second matching element 137*b* are electrically connected to the common end RFC and the connecting member 131*c*. The other ends of the first matching element 137*a* and the second matching element 137*b* are grounded. In other words, the first matching element 137*a* and the second matching element 137*b* are connected in parallel between the common end RFC and ground.

In one embodiment, the first matching element 137*a* is a capacitor with a capacitance value of 0.9 pF. The second matching element 137*b* is an inductor with an inductance value of 4.7 nH. Similarly, in this disclosure, a specific circuit structure of the matching unit 137 is not limited. For example, the matching unit 137 may include other capacitors, inductors, and/or combinations of capacitors and inductors.

In this embodiment, the first matching circuit 133, the second matching circuit 134, the third matching circuit 135, the fourth matching circuit 136, and the matching unit 137 are each a distributed electronic component, that is, they are respectively composed of distributed circuits. Of course, in this embodiment, the first matching circuit 133, the second matching circuit 134, the third matching circuit 135, the fourth matching circuit 136, and the matching unit 137 can also be integrated/lumped together circuits, that is, they can be composed of independent chips and/or modules.

In this embodiment, the first transmission line 14 can be a cable, a stranded wire, a soft circuit board, a hard circuit board, a metal pin, and other signal transmission components, there being no specific limitation. Similarly, the second transmission line 15 can be a cable, a stranded wire, a flexible circuit board, a hard circuit board, a metal pin, and other signal transmission components, without limitation.

In this embodiment, the first transmission line 14 and the second transmission line 15 form a transmission unit 16. Of course, in other embodiments, the first transmission line 14 and the second transmission line 15 can be integrated together, that is, the signal feeding assembly 10 shares the transmission unit 16 (that is, a transmission line), to transmit and receive RF signals (such as high frequency signals) and fundamental frequency signals (such as control signals).

In this embodiment, the connecting members 131*a*, 131*b*, 131*c*, 131*d* can be connectors or connection points, and other connecting elements, without specific restrictions. That is, in this embodiment, a manner of connection among the control end 131, the first transmission line 14, and the basic frequency circuit 201 is not limited. For example, the control end 131, the first transmission line 14, and the basic frequency circuit 201 may be connected by means of connectors or other means. Similarly, in this embodiment, the connection among the common end RFC, the second transmission line 15, and the RF circuit 202 is not limited. For example, the common end RFC, the second transmission line 15, and the RF circuit 202 can be connected by means of connectors or other means.

Figure 7:
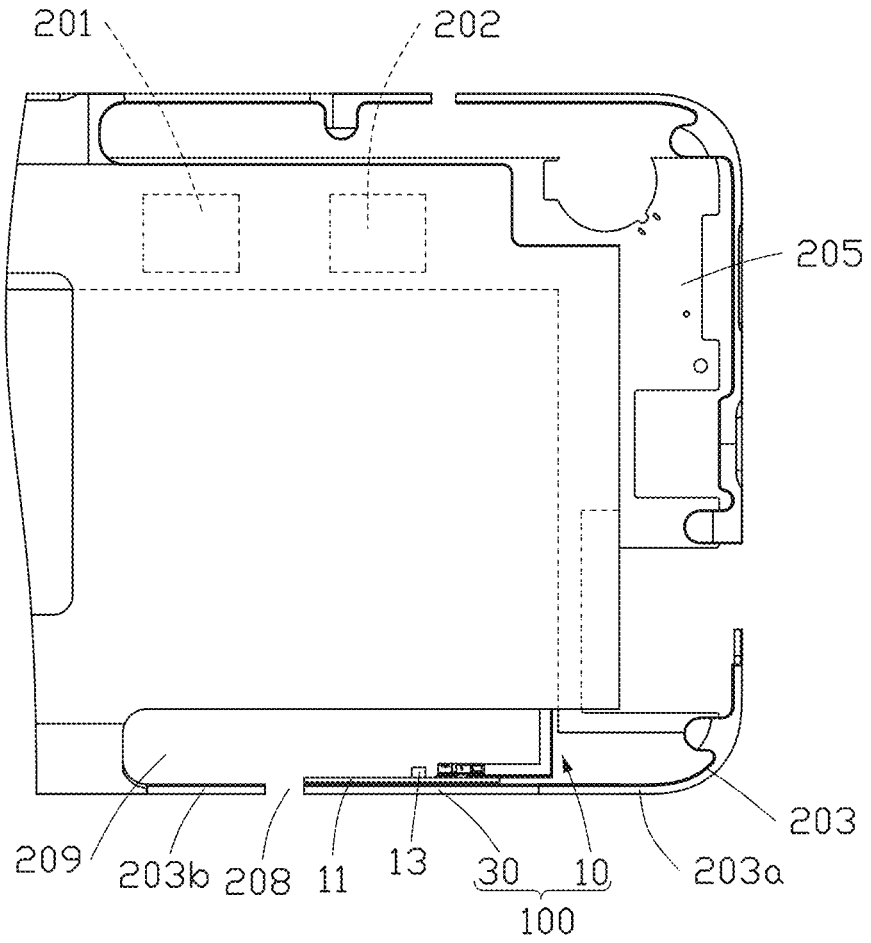
FIG. 7 is a partial schematic diagram of the electronic equipment of FIG. 6 from another angle.
Figure 8:
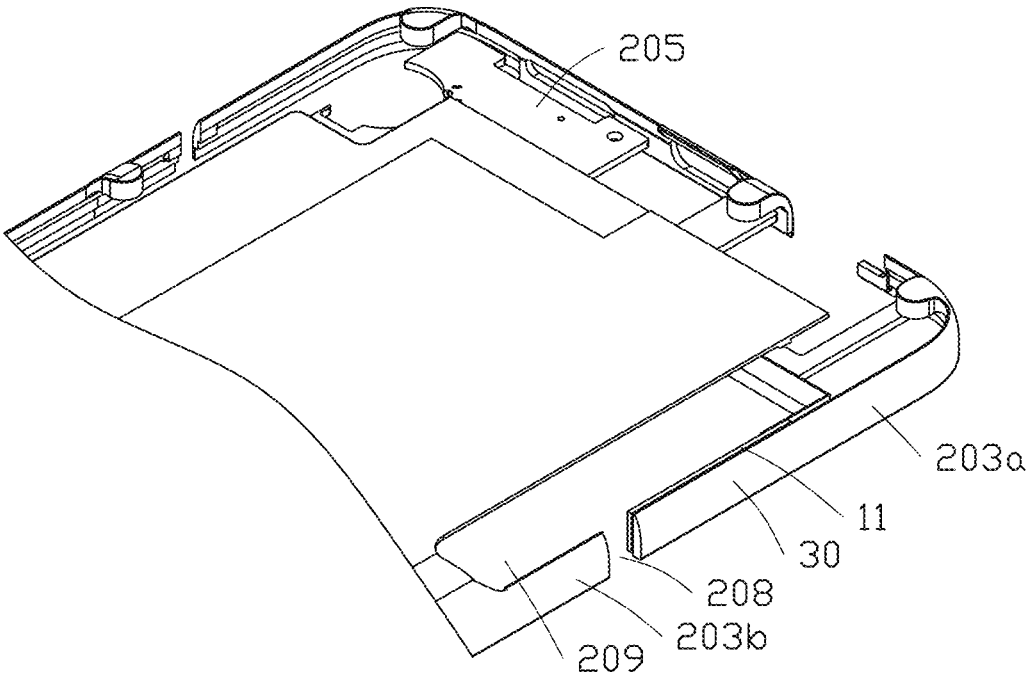
FIG. 8 is a schematic diagram of the electronic equipment of FIG. 6 from another angle.

In this embodiment, when the signal feeding assembly 10 is used, the signal feeding assembly 10 is spaced from a radiation element 30 (see FIG. 7 and FIG. 8). Specifically, the radiation element 30 is set at intervals with the signal coupling unit 12 on the substrate 11. Further, the signal feeding assembly 10 and the radiation element 30 jointly form the antenna module 100. The antenna module 100 may couple the signal from the signal coupling unit 12 to the radiation element 30 through the coupling of the signal coupling unit 12, and then transmit and/or receive signals through the radiation element 30, and thereby work in multiple modes. Meanwhile, the antenna module 100 also uses the switching unit 13 to switch between the multiple modes and realize multiple broadband operations.

For example, FIG. 3A to FIG. 3D show a schematic diagram of an actuating principle of the switching unit 13. In this embodiment shown in FIG. 3A to FIG. 3D, the switching unit 13 is a QAT3516 chip as an example. FIG. 3A to FIG. 3D show an internal circuit structure of the switching unit 13 (the control terminal 131 is not shown). The switching unit 13 is internally provided with a switch S1-S10 and a matching module Ct. The first ends of the switches S1-S4 are connected together and are electrically connected to the common end RFC. The second ends of the switches S1-S4 are electrically connected to a corresponding switching output end. For example, the second end of the switch S1 is electrically connected to the first switching output end RF1. The second end of the switch S2 is electrically connected to the second switching output end RF2. The second end of the switch S3 is electrically connected to the third switching output end RF3. The second end of the switch S4 is electrically connected to the fourth switching output end RF4.

The first end of the switch S5 is electrically connected to the second end of the switch S1 and the first switching output end RF1, and the second end of the switch S5 is grounded. The first end of the switch S6 is electrically connected to the second end of the switch S2 and the second switching output end RF2, and the second end of the switch S6 is grounded. The first end of the switch S7 is electrically connected to the second end of the switch S3 and the third switching output end RF3, and the second end of the switch S7 is grounded. The first end of the switch S8 is electrically connected to the second end of the switch S4 and the fourth switching output end RF4, and the second end of the switch S8 is grounded.

The matching module Ct includes a first matching capacitor Ct_0 and a second matching capacitor Ct_1. The first matching capacitor CT_0 and the second matching capacitor Ct_1 are connected together and are electrically connected to the first ends of the switches S1-S4 and the common end RFC. The second end of the first matching capacitor Ct_0 is grounded through the switch S9. The second end of the second matching capacitor Ct_1 is grounded through the switch S10. In one embodiment, a capacitance of the first matching capacitor Ct_0 is 0.5 pF. A capacitance of the second matching capacitor Ct_1 is 1 pF.

Figure 3A:
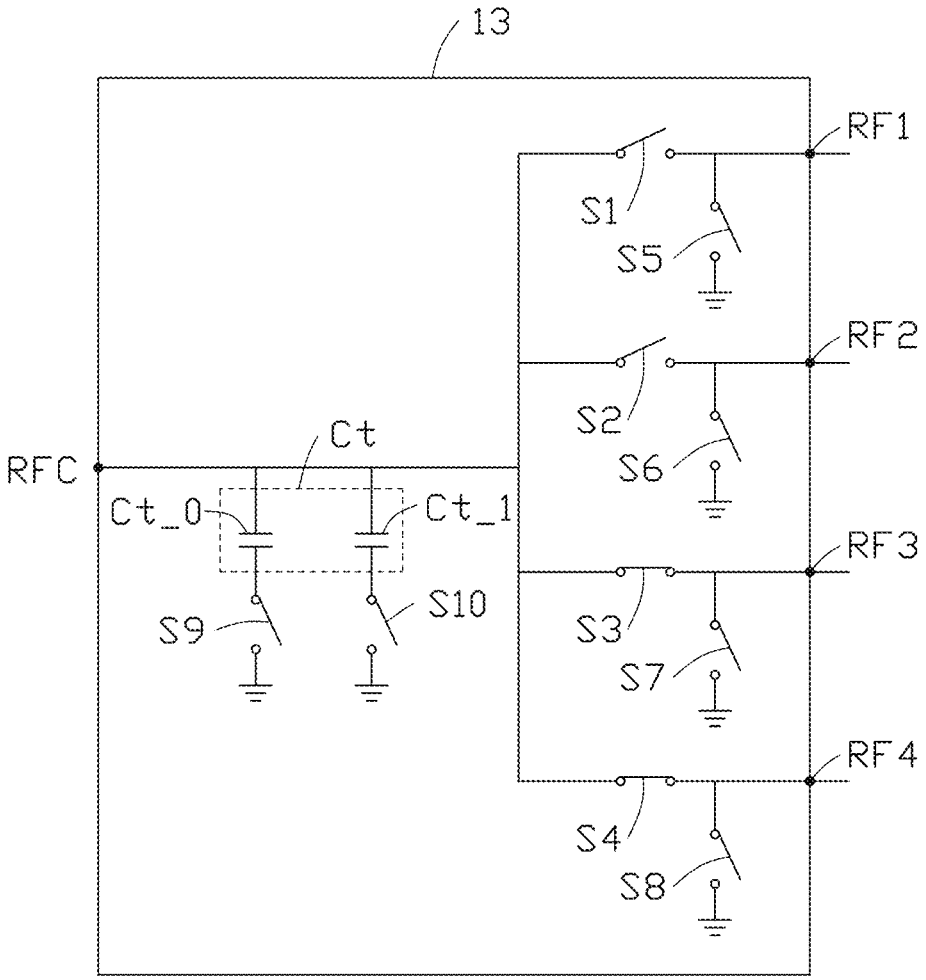
FIG. 3A, FIG. 3B, FIG. 3C, and FIG. 3D are schematic diagrams, showing a switching unit of the signal feeding assembly of FIG. 2 switching to different states.

Referring to FIG. 3A, when the switching unit 13 switches to the third switching output end RF3 and the fourth switching output end RF4 (for example, by closing the switches S3 and S4 inside the switching unit 13, and opening the switches S1, S2 and S5-S10), to turn on the third switching output end RF3 and the fourth switching output end RF4, the antenna module 100 can operate in a first working mode to generate a radiation signal of a first radiation frequency band.

Figure 3B:
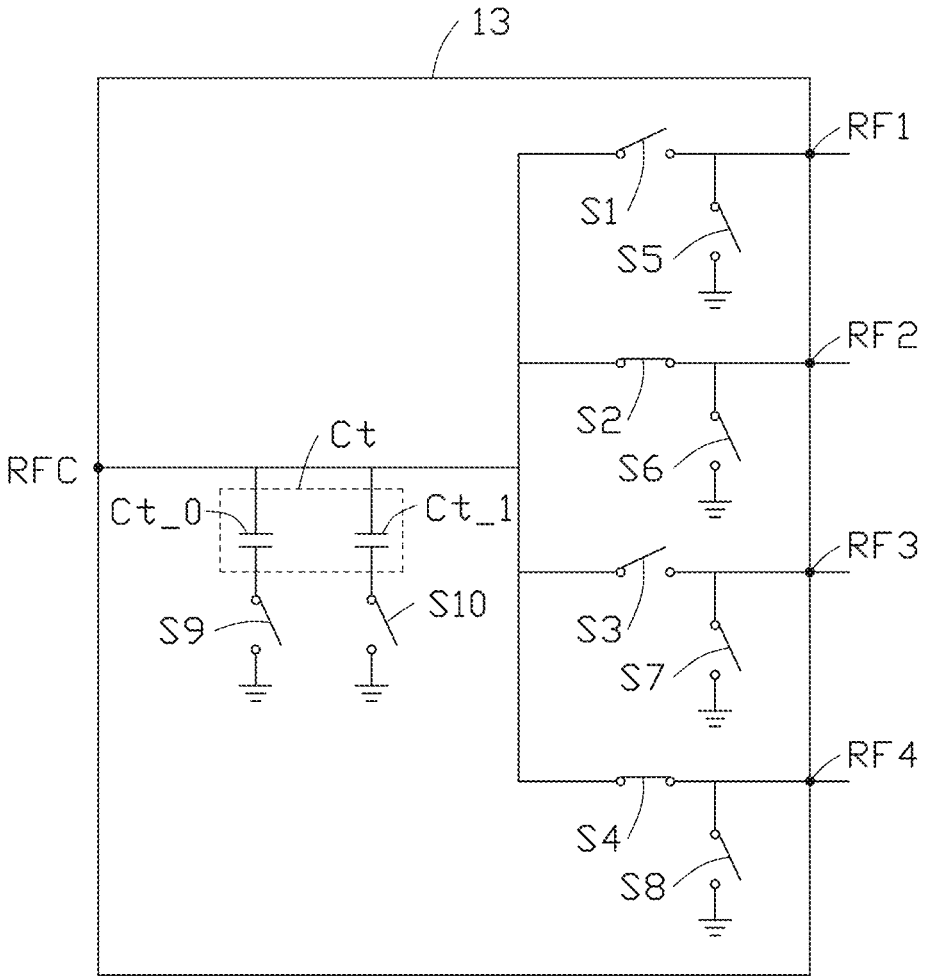

Referring to FIG. 3B, when the switching unit 13 switches to the second switching output end RF2 and the fourth switching output end RF4 (for example, by closing the switches S2 and S4 inside the switching unit 13, and opening the switches S1, S3 and S5-S10), to turn on the second switching output end RF2 and the fourth switching output end RF4, the antenna module 100 can operate in a second working mode to generate a radiation signal of a second radiation frequency band.

Figure 3C:
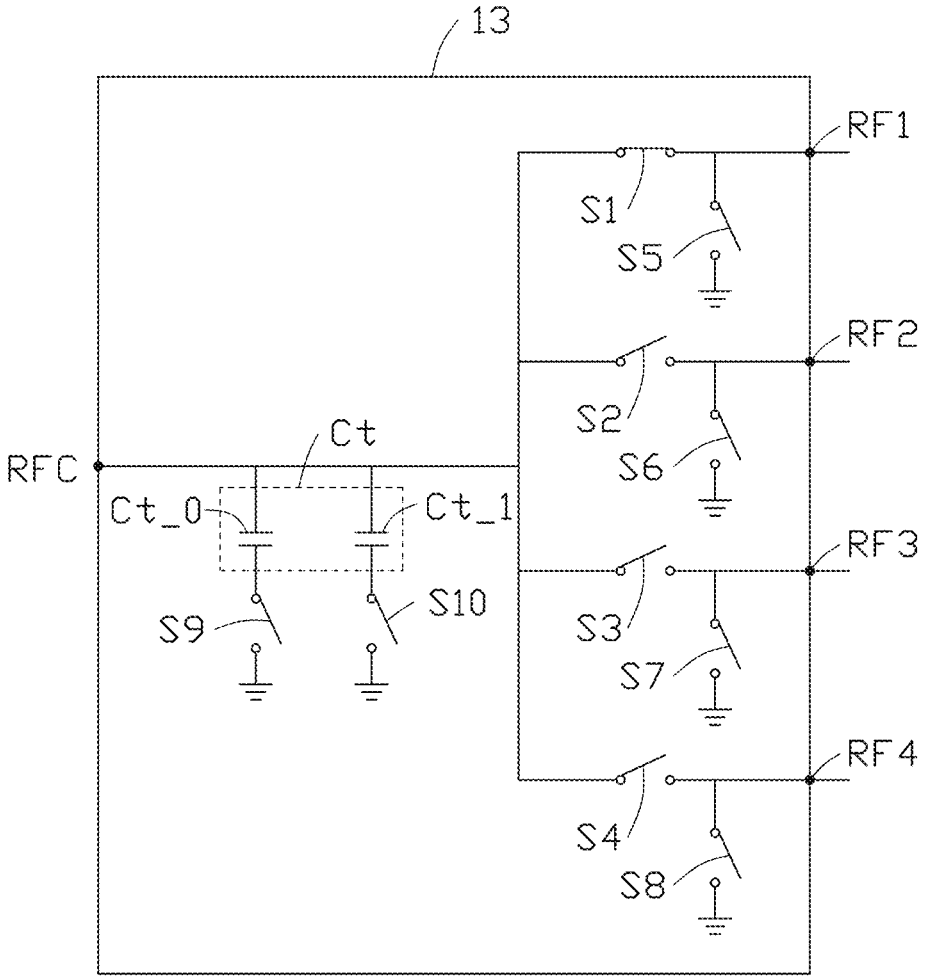

Referring to FIG. 3C, when the switching unit 13 switches to the first switching output end RF1 (for example, by closing the switch S1 inside the switching unit 13 and opening the switches s2-s10) to turn on the first switching output end RF1, the antenna module 100 can operate in a third working mode to generate a radiation signal of a third radiation frequency band.

Figure 3D:
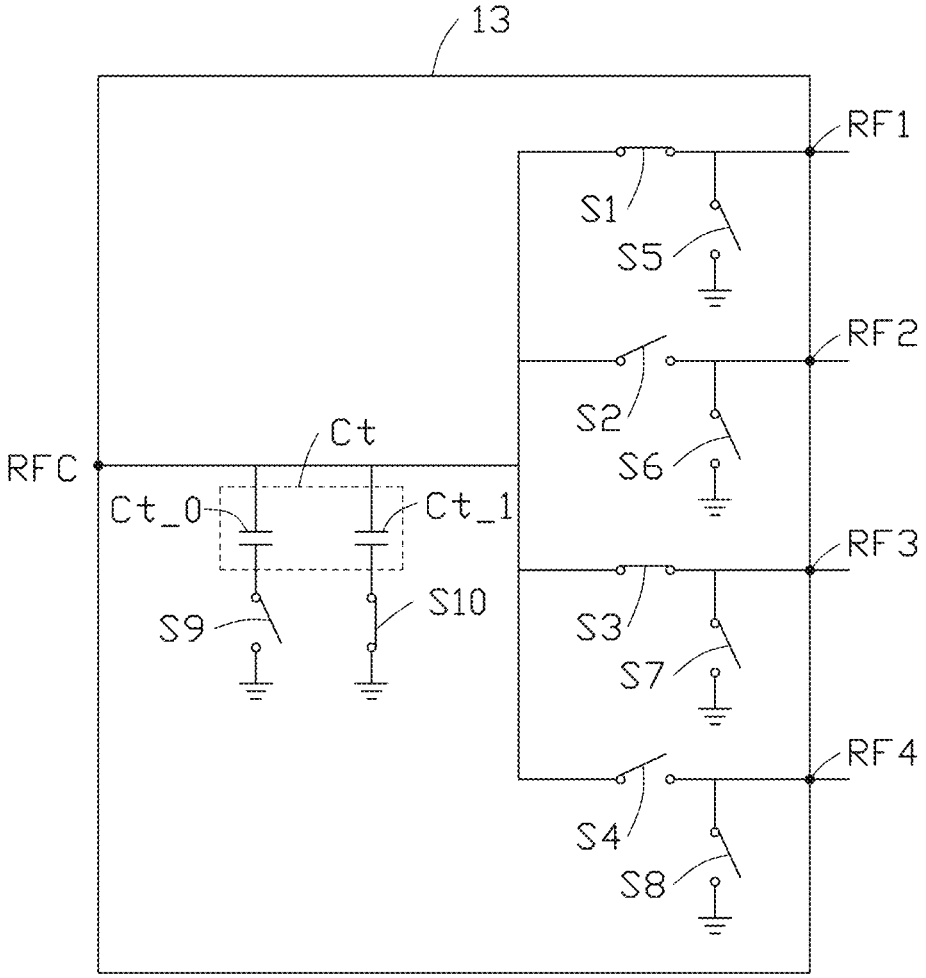

Referring to FIG. 3D, when the switching unit 13 switches to the first switching output end RF1, the third switching output end RF3, and the second matching element 137*b* (for example, by closing the switches S1, S3 and S10 inside the switching unit 13 and opening the switches S2, S4 and S5-S9) to turn on the first switching output end RF1, the third switching output end RF3, and the second matching element 137*b*, the antenna module 100 can operate in a fourth working mode to generate a radiation signal of a fourth radiation frequency band.

In this embodiment, the first working mode is a first middle and high frequency radiation mode. A frequency of the first radiation frequency band is 1805-1880 MHz. The second working mode is a second middle and high frequency radiation mode. A frequency of the second radiation frequency band includes 1880-2690 MHz. The third working mode is a first high frequency radiation mode. A frequency of the third radiation frequency band includes 3300-4200 MHz. The fourth working mode is a second high frequency radiation mode. A frequency of the fourth radiation frequency band includes 4400-5000 MHz. By setting the switching unit 13 to realize a switching combination of different paths, the antenna module 100 can achieve multiband operation to meet a system operation requirements of 2G/3G/4G/ and 5G sub-6.

In this embodiment, the frequency of the antenna module 100 is not limited. For example, a required frequency of the antenna module 100 can be adjusted by adjusting a shape, a length, a width, and other parameters of the antenna module 100. In addition, the shape, length, width, and other parameters of the coupling pieces can also be adjusted according to the frequency which is required.

As shown in FIG. 7 and FIG. 8, in one of the embodiments, the radiation element 30 is a metal frame of an electronic device (see details later) and is spaced from the substrate 11. Of course, in this embodiment, a material and composition of the radiation element 30 are not limited. For example, the radiation element 30 can be any conductor, such as iron, copper foil on PCB, or conductor in laser direct structure (LDS) process, etc.

In this embodiment, the radiation element 30 and the substrate 11 are arranged in parallel and a distance between them is about 0.2 mm.

In this embodiment, a specific structure of the radiation element 30 and/or a connection relationship between the radiation element 30 and other elements are not limited. For example, a side end of the radiation element 30 may be connected or not connected to ground. For another example, the radiation element 30 can be provided with gaps, or without, or slots, and slits, etc.

Figure 4:
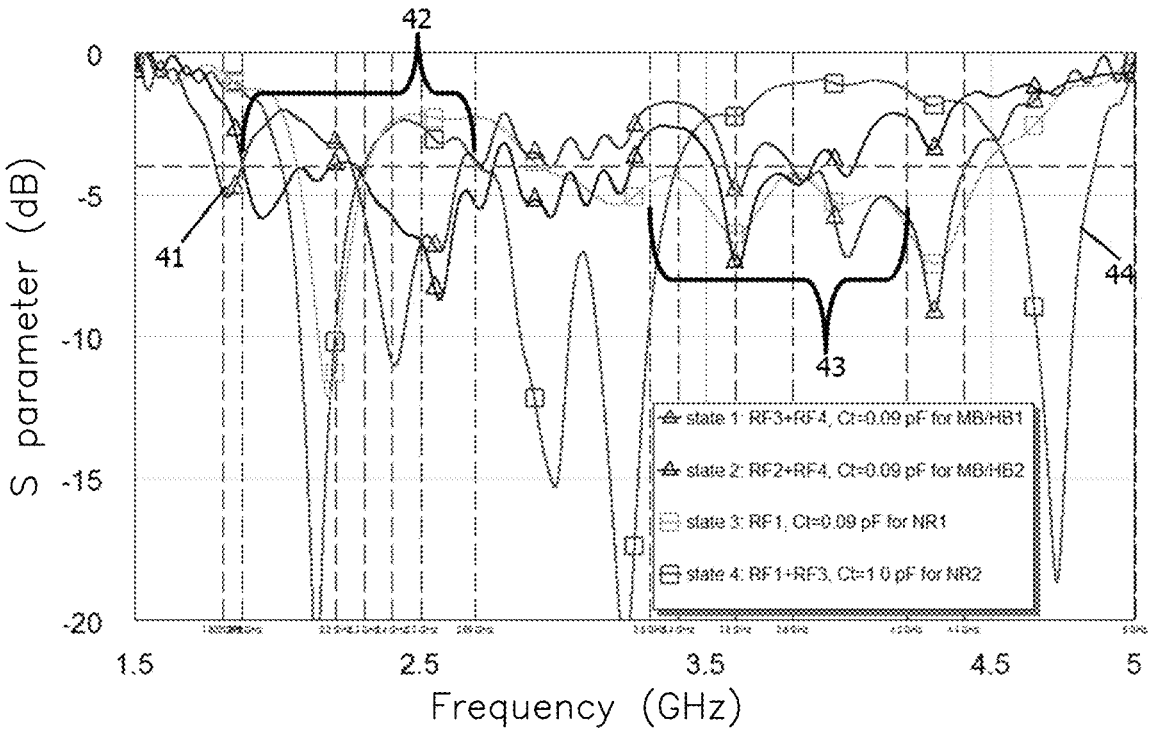
FIG. 4 is a scattering parameter graph of the antenna module of FIG. 1.

FIG. 4 is a scattering parameter graph of the antenna module 100. A curve S41 is an S11 value of the antenna module 100, when the switching unit 13 switches to the state shown in FIG. 3A. A curve S42 is an S11 value of the antenna module 100, when the switching unit 13 switches to the state shown in FIG. 3B. A curve S43 is an S11 value of the antenna module 100, when the switching unit 13 switches to the state shown in FIG. 3C. A curve S44 is an S11 value of the antenna module 100, when the switching unit 13 switches to the state shown in FIG. 3D.

Figure 5:
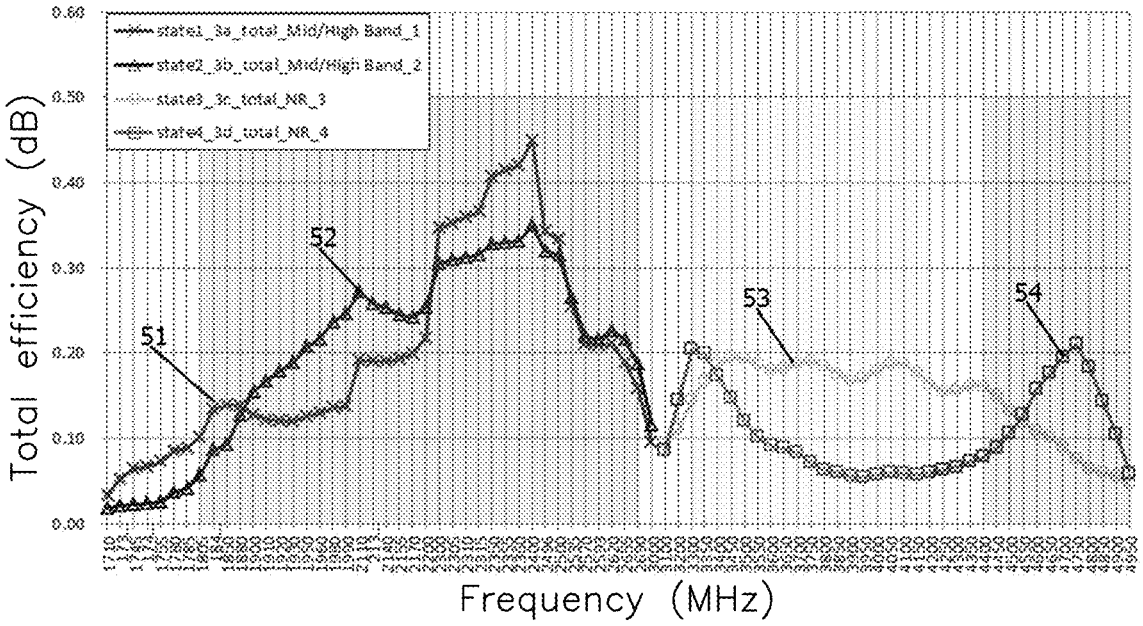
FIG. 5 is an efficiency graph of the antenna module of FIG. 1.

FIG. 5 is a total efficiency graph of the antenna module 100. A curve S51 is a total efficiency of the antenna module 100, when the switching unit 13 switches to the state shown in FIG. 3A. A curve S52 is a total efficiency of the antenna module 100, when the switching unit 13 switches to the state shown in FIG. 3B. A curve S53 is a total efficiency of the antenna module 100, when the switching unit 13 switches to the state shown in FIG. 3C. A curve S54 is a total efficiency of the antenna module 100, when the switching unit 13 switches to the state shown in FIG. 3D. As shown in FIG. 3A to FIG. 3D, FIG. 4, and FIG. 5, by setting the switching unit 13, a combination of different paths can be realized, so that the antenna module 100 can achieve multi-band operation to meet the system operation requirements of 2G/3G/4G/5G sub-6.

Figure 6:
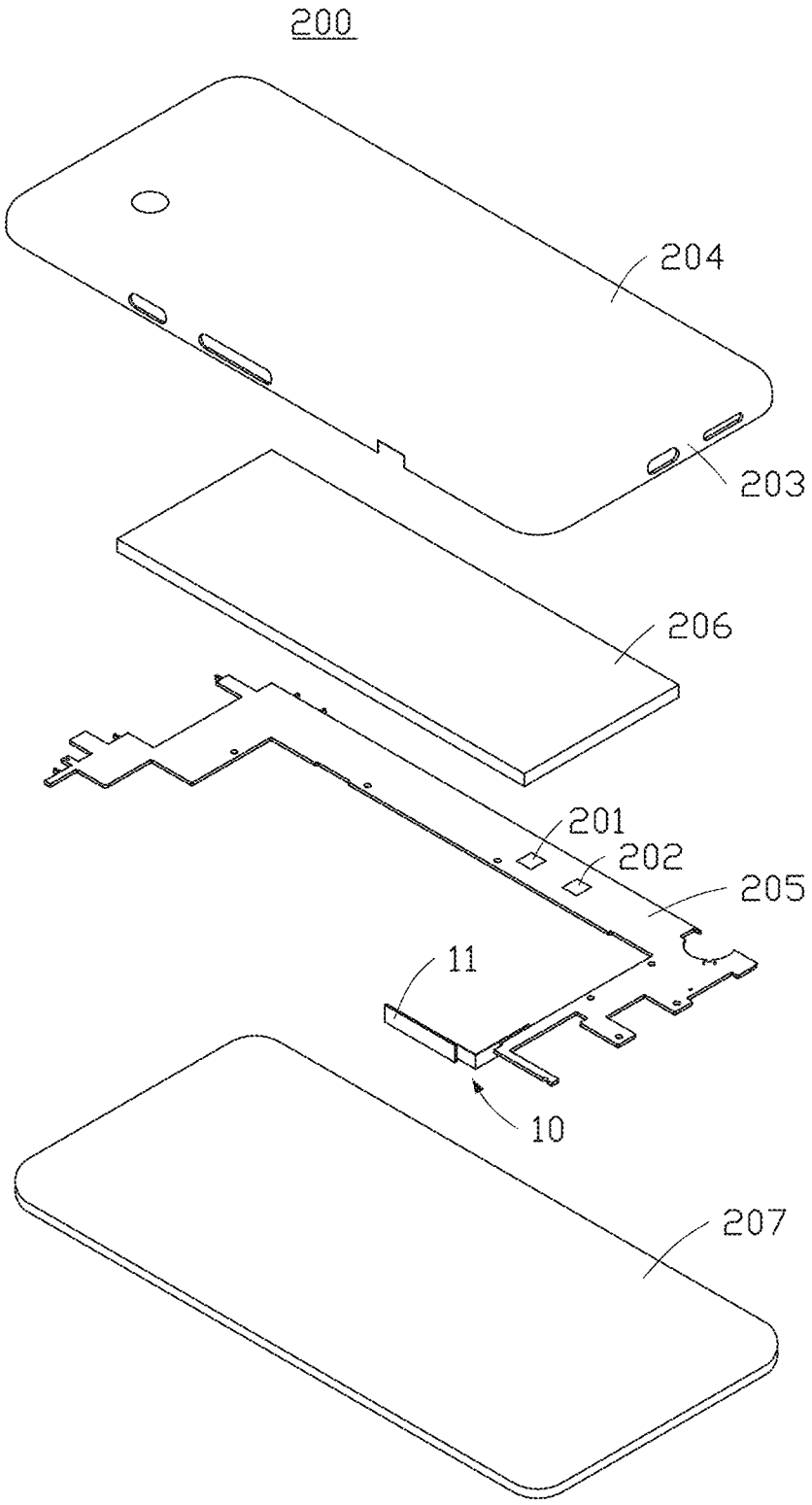
FIG. 6 is an exploded, isometric view of the signal feeding assembly in an electronic equipment according to the present disclosure.

As illustrated in FIG. 6, in this embodiment, the signal feeding assembly 10 can be applied to an electronic device 200, and forms the antenna module 100 with metal elements of the electronic device 200 to transmit and receive radio waves to transmit and exchange radio signals. The electronic device 200 can be, for example, a handheld communication device (such as a mobile phone), a folding machine, an intelligent wearable device (such as a watch, a headset, etc.), a tablet computer, a personal digital assistant (PDA), etc.

In this embodiment, the electronic device 200 may use one or more of the following communication technologies: BLUETOOTH communication technology, global positioning system (GPS) communication technology, WI-FI communication Technology, global system for mobile communications (GSM) communication technology, wideband code division multiple access (WCDMA) communication technology, long term evolution (LTE) communication technology, 5G communication technology, SUB-6G communication technology, and other communication technologies.

In this embodiment, the electronic device 200 is a mobile phone taken as an example to illustrate.

As illustrated in FIG. 6, FIG. 7, and FIG. 8, the electronic device 200 at least includes the baseband circuit 201 (refer to FIG. 7), the RF circuit 202 (refer to FIG. 7), a side frame 203, a back board 204, a system circuit board 205, a battery 206, and a display module 207.

The side frame 203 is made of metal or other conductive materials. The back board 204 may be made of metal or other conductive materials. The side frame 203 is arranged at an edge of the back board 204. The side frame 203 and the back board 204 can be integrated. An opening (not shown) is defined at the side of the side frame 203 relative to the back board 204 for receiving the display module 207. The display module 207 can be combined with a touch sensor to form a touch screen. The touch sensor is also called a touch panel or a touch sensitive panel.

The system circuit board 205 can be arranged in a receiving space surrounded by the side frame 203 and the back board 204. The system circuit board 205 includes the baseband circuit 201 and the RF circuit 202.

The battery 206 may be arranged on the system circuit board 205 or the system circuit board 205 arranged around the battery 206. The battery 206 is used to provide electric energy for the electronic components, modules, circuits, of the electronic device 200.

In other embodiments, the electronic device 200 may also include one or more components, such as a processor, a circuit board, a memory, an input/output circuit, audio components (such as a microphone and a speaker, etc.), imaging components (for example, a front camera and/or a rear camera), and several sensors (such as a proximity sensor, a distance sensor, an ambient light sensor, an acceleration sensor, a gyroscope, a magnetic sensor, a pressure sensor, and/or a temperature sensor, etc.).

In this embodiment, when the signal feeding assembly 10 is applied to the electronic device 200, the signal feeding assembly 10 can be arranged in the electronic device 200, and a portion of the metal side frame 203 forms the radiation element 30, both constituting the antenna module 100 of the electronic device 200. In detail, the side frame 203 defines a gap 208. The gap 208 penetrates and interrupts the side frame 203 to divide the side frame 203 into a first portion 203*a* and a second portion 203*b*. The back board 204 also defines an opening 209. The opening 209 is arranged along a long side of the side frame 203 (that is, the long metal side of the electronic device 200) and is approximately in a strip shape. In this embodiment, the opening 209 also communicates with the gap 208 and forms a structure roughly in shape of a T with the gap 208.

The electronic device 200 corresponding to the opening 209 is used to hold the signal feed assembly 10. That is to say, the signal feeding assembly 10 can be arranged in the internal location of the electronic device 200 corresponding to the opening 209, and is arranged in parallel with the first portion 203*a*. A portion of the first portion 203*a* forms the radiation element 30. The second portion 203*b* can be grounded. Specifically, in this embodiment, the signal feeding assembly 10 of the antenna module 100 is set vertically to the back board 204 and parallel to the first portion 203*a*. The signal coupling unit 12 on the signal feed assembly 10 is arranged on the side of the substrate 11 away from the first portion 203*a*, that is, the signal coupling unit 12 is arranged away from the first portion 203*a*.

In one embodiment, the gap 208 and the opening 209 can be filled with an insulating material (such as plastic, rubber, glass, wood, ceramic, etc., not being limited to these).

Of course, in other embodiments, the slot 208 and/or the opening 209 can be omitted. That is, the signal feed assembly 10 of the antenna module 100 is directly arranged inside the electronic device 200, to ensure that the signal feed assembly 10 is spaced from the side frame 203 of the electronic device 200, and the portion of the side frame 203 forms the radiation element 30. Then, the signal feeding assembly 10 and a portion of the side frame 203 together form the antenna module 100, which can effectively realize the transmission and reception of multi-frequency signals.

As another example, in other embodiments, when the antenna module 100 is applied to the electronic device 200, the signal feeding assembly 10 can also be set inside the electronic device 200, and the antenna module 100 includes an independent radiation element 30. That is, no part of the metal side frame 203 is used as a radiation element 30.

Obviously, in this embodiment, the signal feeding assembly 10 of the antenna module 100 is modularized, so it can be easily integrated into a metal casing of the electronic device 200, and then a radiation energy is coupled to the metal casing through a coupling method (that is, through the signal coupling unit 12), and the different frequency resonance modes are switched through the switching unit 13, to achieve a multi-band operation. Compared with the existing metal housing antenna design, the antenna module 100 of this disclosure meets the operation requirements of 3G/4G/5G sub-6/Wi-Fi/ and GPS and other frequency bands without having a customized metal shell shape. Furthermore, the antenna of this disclosure does not need a special gap, a structure, and a circuit design on the metal housing, it can use the existing metal housing design style, which shortens the product development time and cost, simplifies the design, and improves product competitiveness.

Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A signal feeding assembly, comprising:

a substrate;

a transmission unit positioned on the substrate;

a switching unit positioned on the substrate and comprising a control end, a common end, and at least two switching output ends, wherein the control end and the common end are electrically connected to the transmission unit to transmit and receive baseband signals and radio frequency signals through the transmission unit; and a signal coupling unit positioned on the substrate, wherein the signal coupling unit is spaced apart from a radiation element to transmit and receive the baseband signals and the radio frequency signals through the radiation element to generate a plurality of radiation modes;

wherein the signal coupling unit comprises at least two coupling pieces, each of the coupling pieces is electrically connected to a switching output end, the switching unit controls a switching of the coupling pieces through the switching output ends to switch the plurality of radiation modes.

2. The signal feeding assembly of claim 1, wherein the switching unit further comprises at least two matching circuits, each of the switching output ends is electrically connected to a coupling piece or is grounded through a corresponding one of the matching circuits, and each of the matching circuits is a lumped circuit or a distributed circuit.

3. The signal feeding assembly of claim 1, wherein the switching unit further comprises a matching unit, the common end is grounded through the matching unit, and the matching unit is a lumped circuit or a distributed circuit.

4. The signal feeding assembly of claim 1, wherein the transmission unit comprises a first transmission line and a second transmission line, the control end is electrically connected to a baseband circuit through the first transmission line to receive and transmit the baseband signals, and the common end is electrically connected to a radio frequency circuit through the second transmission line to receive and transmit the radio frequency signals.

5. The signal feeding assembly of claim 1, wherein the transmission unit comprises a transmission line, each of the control end and the common end is electrically connected to the transmission line to electrically connect to a baseband circuit and a radio frequency circuit through the transmission line.

6. The signal feeding assembly of claim 1, wherein the signal coupling unit comprises three coupling pieces, the three coupling pieces are spaced apart from each other, the switching unit comprises four switching output ends, three of the switching output ends are respectively electrically connected to a corresponding one of the coupling pieces, and a remaining of the switching output ends is grounded, the radiating element excites at least two radiation modes by switching to different coupling pieces.

7. The signal feeding assembly of claim 6, wherein the at least two radiation modes comprise a first middle and high frequency radiation mode, a second middle and high frequency radiation mode, a first high frequency radiation mode, and a second high frequency radiation mode.

8. An antenna module, comprising:

a radiation element; and a signal feeding assembly, the signal feeding assembly comprising:

a substrate;

a transmission unit positioned on the substrate;

a switching unit positioned on the substrate and comprising a control end, a common end, and at least two switching output ends, the control end and the common end electrically connected to the transmission unit to transmit and receive baseband signals and radio frequency signals through the transmission unit; and a signal coupling unit positioned on the substrate, the signal coupling unit spaced apart from the radiation element to transmit and receive the baseband signals and the radio frequency signals through the radiation element to generate a plurality of radiation modes;

wherein the signal coupling unit comprises at least two coupling pieces, each coupling piece is electrically connected to a switching output end, the switching unit controls a switching of the coupling pieces through the switching output ends to switch the plurality of radiation modes.

9. The antenna module of claim 8, wherein the switching unit further comprises at least two matching circuits, each switching output end is electrically connected to a coupling piece or is grounded through a corresponding matching circuit, and the matching circuit is a lumped circuit or a distributed circuit.

10. The antenna module of claim 8, wherein the switching unit further comprises a matching unit, the common end is grounded through the matching unit, and the matching unit is a lumped circuit or a distributed circuit.

11. The antenna module of claim 8, wherein the transmission unit comprises a first transmission line and a second transmission line, the control end is electrically connected to a baseband circuit through the first transmission line to receive and transmit the baseband signals, and the common end is electrically connected to a radio frequency circuit through the second transmission line to receive and transmit the radio frequency signals.

12. The antenna module of claim 8, wherein the transmission unit comprises a transmission line, the control end and the common end are electrically connected to the transmission line to electrically connect to a baseband circuit and a radio frequency circuit through the transmission line.

13. The antenna module of claim 8, wherein the signal coupling unit comprises three coupling pieces, the three coupling pieces are spaced apart from each other, the switching unit comprises four switching output ends, the three switching output ends are respectively electrically connected to a corresponding coupling piece, and the other switching output end is grounded, the radiating element excites at least two radiation modes by switching to different coupling pieces, the at least two radiation modes comprises a first middle and high frequency radiation mode, a second middle and high frequency radiation mode, a first high frequency radiation mode, and a second high frequency radiation mode.

14. An electronic device, comprising:

a side frame made of metal material; and a signal feeding assembly, the signal feeding assembly positioned inside the electronic device and comprising:

a substrate;

a transmission unit positioned on the substrate;

a switching unit positioned on the substrate and comprising a control end, a common end, and at least two switching output ends, the control end and the common end electrically connected to the transmission unit to transmit and receive baseband signals and radio frequency signals through the transmission unit; and a signal coupling unit positioned on the substrate, the signal coupling unit spaced apart from the side frame to transmit and receive the baseband signals and the radio frequency signals through the side frame to generate a plurality of radiation modes;

wherein the signal coupling unit comprises at least two coupling pieces, each coupling piece is electrically connected to a switching output end, the switching unit controls a switching of the coupling pieces through the switching output ends to switch the plurality of radiation modes.

15. The electronic device of claim 14, wherein the side frame defines a gap, the electronic device defines an opening communicated with the gap;

wherein the signal feeding assembly is received in the opening, parallel with the side frame, and adjacent to the gap.

16. The electronic device of claim 14, wherein the switching unit further comprises at least two matching circuits, each switching output end is electrically connected to a coupling piece or is grounded through a corresponding matching circuit, and the matching circuit is a lumped circuit or a distributed circuit.

17. The electronic device of claim 14, wherein the switching unit further comprises a matching unit, the common end is grounded through the matching unit, and the matching unit is a lumped circuit or a distributed circuit.

18. The electronic device of claim 14, wherein the transmission unit comprises a first transmission line and a second transmission line, the control end is electrically connected to a baseband circuit through the first transmission line to receive and transmit the baseband signals, and the common end is electrically connected to a radio frequency circuit through the second transmission line to receive and transmit the radio frequency signals.

19. The electronic device of claim 14, wherein the transmission unit comprises a transmission line, the control end and the common end are electrically connected to the transmission line to electrically connect to a baseband circuit and a radio frequency circuit through the transmission line.

20. The electronic device of claim 14, wherein the signal coupling unit comprises three coupling pieces, the three coupling pieces are spaced apart from each other, the switching unit comprises four switching output ends, the three switching output ends are respectively electrically connected to a corresponding coupling piece, and the other switching output end is grounded, the radiating element excites at least two radiation modes by switching to different coupling pieces, the at least two radiation modes comprises a first middle and high frequency radiation mode, a second middle and high frequency radiation mode, a first high frequency radiation mode, and a second high frequency radiation mode.

* * * * *